US005892184A

United States Patent [19]

D'Hoogh

[11] Patent Number: 5,892,184

[45] Date of Patent: Apr. 6, 1999

[54] PASSIVE RADIATOR AND SYSTEM COMPRISING THE PASSIVE RADIATOR

[75] Inventor: Guido O.M. D'Hoogh, Dendermonde, Belgium

[73] Assignee: U.S. Philips Corporation, New York, N.Y.

[21] Appl. No.: 859,589

[22] Filed: May 20, 1997

[30] Foreign Application Priority Data

May 31, 1996 [EP] European Pat. Off. ..... 96201519

[51] Int. Cl.[6] ..... G10K 13/00

[52] U.S. Cl. ..... 181/171; 181/172; 181/156

[58] Field of Search ..... 181/171, 172, 181/173, 174, 166, 156; 381/188, 192, 193, 198, 205

[56] References Cited

U.S. PATENT DOCUMENTS

| | | | |
|---|---|---|---|
| 2,490,466 | 12/1949 | Olson et al. | 181/171 |
| 2,630,189 | 3/1953 | Julie | 181/172 |
| 3,669,215 | 6/1972 | Kikuchi et al. . | |
| 3,905,448 | 9/1975 | Kawakami et al. | 181/172 |
| 4,206,832 | 6/1980 | Yocum | 181/172 |
| 5,111,510 | 5/1992 | Mitobe | 181/172 |

*Primary Examiner*—Khanh Dang

[57] ABSTRACT

A passive radiator comprising a chassis, a mass element suspended within the chassis, and a suspension means for flexibly suspending the mass element from the chassis. In order to obtain a large amplitude of the mass element, a sub-chassis extends between the chassis and the mass element, first flexible connecting elements connecting the mass element to the sub-chassis, and second flexible connecting elements connecting the sub-chassis to the chassis.

11 Claims, 3 Drawing Sheets

PASSIVE RADIATOR AND SYSTEM COMPRISING THE PASSIVE RADIATOR

BACKGROUND OF THE INVENTION

The invention relates to a passive radiator comprising a chassis, a mass element having a front part and a back part and disposed within the chassis, and a suspension means for movably suspending the mass element from the chassis.

Such a passive radiator is known from U.S. Pat. No. 3,669,215 and is intended for use in a bass-reflex loudspeaker system. The known passive radiator comprises a mass element having a disc-shaped part and a conical part, the conical part being connected to a front part of a chassis via a deformable suspension rim and the disc-shaped part being connected to a back part of the chassis via elastic wire elements. The suspension used, comprising the deformable suspension rim and said elastic wire elements, allows only limited axial excursions of the mass element, i.e. excursions in directions transverse to the disc-shaped part, relative to the chassis. As a result of this, a comparatively large mass element, particularly as viewed in the transverse direction, is necessary in order to achieve an effect requiring a large volume displacement.

SUMMARY OF THE INVENTION

It is an object of the invention to improve the passive radiator of the type defined in the opening paragraph so as to obtain a compact passive radiator with a comparatively large volume displacement capacity.

According to the invention, the passive radiator in accordance with the invention is characterized by the presence of a sub-chassis, which extends between the chassis and the mass element, the suspension means connecting the sub-chassis telescopically to the mass element and telescopically to the chassis. Owing to the use of a sub-chassis an axial excursion of the mass element relative to the chassis is determined by a first axial excursion of the mass element relative to the sub-chassis and a second axial excursion of the sub-chassis relative to the chassis. For completeness' sake, it is to be noted that axial excursions are to be understood excursions oriented along the central axis of the mass element, which axis extends from a first part, i.e. the back part, to a second part, i.e. the front part, of the mass element. The maximum axial excursion of the mass element is also referred to as the stroke or amplitude of the mass element.

Since the passive radiator in accordance with the invention comprises a sub-chassis which is axially movable relative to the chassis and the mass element, a large excursion of the mass element can be obtained by the use of connecting elements which fully comply with the imposed mechanical and acoustical requirements, without this giving rise to distortion in the reproduction of sound. The sub-chassis apparently assists the suspension means, as a result of which undesired oscillations caused by pressure variations and/or parasitic resonances are counteracted.

Owing to the large axial excursions to be performed by the mass element relative to the chassis the passive radiator in accordance with the invention can have limited transverse dimensions and can therefore be of a compact construction. In the case of a mass element of circular cross-section the measure in accordance with the invention results in a passive radiator of small diameter in relation to the volume displacement capability.

The passive radiator in accordance with the invention is particularly suitable for uses where not much space is available, such as the limited mounting space in a car, a television set or a monitor, but where a high power sound system is desired.

An embodiment of the passive radiator in accordance with the invention is characterized in that the suspension means comprises a first flexible connecting member, which connects the mass element to the sub-chassis, and a second flexible connecting member, which connects the sub-chassis to the chassis. When connecting members which fully complies with the imposed mechanical and acoustical requirements are used, a large excursion of the mass element can be obtained without this giving rise to distortion in the reproduction of sound.

Preferably, the passive radiator in accordance with the invention comprises ring-shaped connecting members. Such connecting members are preferably coaxially positioned with respect to each other. Preferably, the connecting elements each have a corrugated or undulate structure. The passive radiator known from U.S. Pat. No. 3,669,215 has an omega-shaped mounting rim, by which the mass element is secured to the chassis. In the known passive radiator the degree to which the mounting rim is extensible determines the excursion of the mass element. The shape and dimensions of the mounting rim lie within comparatively narrow limits, which are dictated inter alia by the required resistance to pressure variations prevailing in operation and the ability to deform smoothly, i.e. without annoying symptoms, such as collapsing or bulging, during excursions of the mass element. A mounting rim which is too compliant and/or not smoothly deformable gives rise to distortion, particularly second and higher harmonic distortion in the reproduction of sound and, consequently, to undesirable noises. Therefore, enlarging the mounting rim will not yield a satisfactory result. Indeed, if an increase of the excursion is obtained, this will be attended by a deteriorated reproduction of sound.

An embodiment of the passive radiator in accordance with the invention is characterized in that the first connecting member comprises two flexible first connecting elements, which connect the mass element to the sub-chassis at the front part and at the back part.

An embodiment of the passive radiator in accordance with the invention is characterized in that the second connecting member comprises two flexible connecting elements, which connect the sub-chassis to the chassis at least substantially at the location of the front part and at least substantially at the location of the back part of the mass element. Said first and said second connecting elements are preferably ring-shaped and preferably have corrugated or undulate structures.

In the passive radiator in accordance with the invention the connecting elements are preferably positioned so as to be coaxial with one another. The first connecting elements and the second connecting elements are then, for example, coplanar in pairs.

The connecting elements used in the passive radiator in accordance with the invention mainly allow excursions of the mass element along a translation axis of the mass element and impede other movements. In other words, the connecting elements are comparatively compliant viewed in the desired directions of movement of the mass element and comparatively stiff in other directions, as a result of which tilting movements of the sub-chassis are counteracted and well-defined translatory movements of the mass element are guaranteed. Said translation axis coincides with the central axis defined elsewhere in the present document.

Preferably, the first connecting elements as well as the second connecting elements have the same properties, particularly mechanical properties. In a practical embodiment the first connecting elements and/or the second connecting elements can be constructed as omega-shaped rims. Preferably, the corrugation crests of the two facing rims are oriented towards or away from one another in order to obtain a symmetrical suspension. It is effective to adapt the shape of the sub-chassis to the shape of the chassis. Thus, it is preferred to use a conical sub-chassis in the case of a conical chassis and a cylindrical sub-chassis in the case of a cylindrical chassis.

The invention further relates to a passive radiator comprising a chassis, a mass element having a front part and a back part and disposed within the chassis, and a suspension means for flexibly suspending the mass element from the chassis, which radiator is characterized by the presence of a sub-chassis, which extends between the chassis and the mass element, the suspension means comprising a first flexible connecting member, which connects the mass element to the sub-chassis, and a second flexible connecting member, which connects the sub-chassis to the chassis. This passive radiator has the same favourable properties as mentioned in the preceding part of the description and can have the same characteristic features as defined for the various embodiments.

The invention further relates to a loudspeaker system comprising the electrodynamic loudspeaker in accordance with the invention, the passive radiator in accordance with the invention, and an enclosure (loudspeaker cabinet) which accommodates the loudspeaker and the radiator.

The invention moreover relates to a device for providing audible and/or visual information and accommodating the loudspeaker system in accordance with the invention. Such a device is, for example, an electronic display device.

BRIEF DESCRIPTION OF THE DRAWINGS

The invention will now be described in more detail, by way of example, with reference to the accompanying drawings, in which.

DETAILED DESCRIPTION

Figure 1:
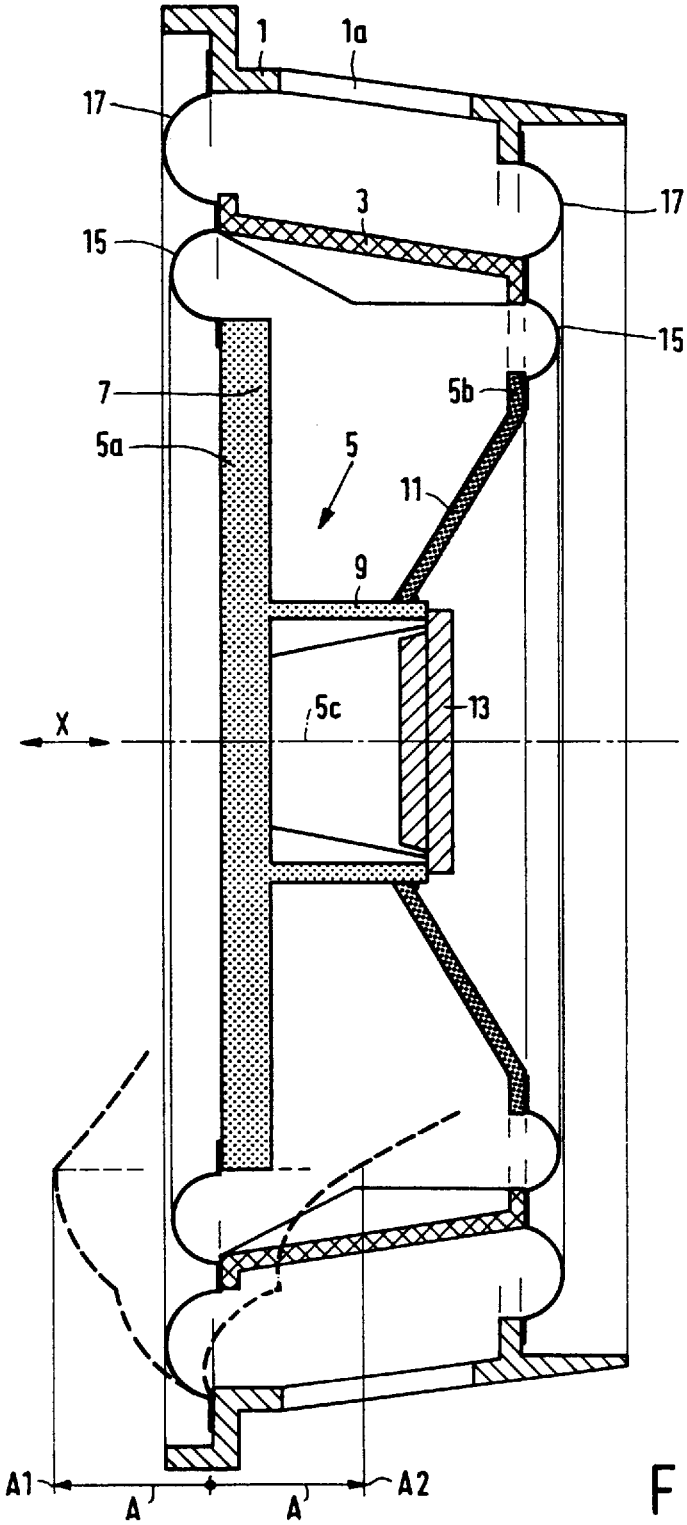
FIG. 1 is a longitudinal sectional view showing a first embodiment of the passive radiator in accordance with the invention.

The passive radiator in accordance with the invention shown in FIG. 1 is suitable for use in a bass-reflex loudspeaker system and comprises a chassis 1, a sub-chassis 3 and a mass element 5. The chassis 1 in the present example has apertures 1*a* and the sub-chassis 3 in the present example is formed by an imperforate solid of revolution. Alternatively, the sub-chassis may be provided with openings. The mass element 5 in the present example comprises a plate-shaped or disc-shaped part 7, a cylindrical central part 9 and a conical part 11. The central part 9 carries a tuning mass 13 for adjusting the resonant frequency in order to tune the desired Helmholtz resonance of system in which the passive radiator is used. A front part 5*a* and a back part 5*b* can be assigned to the mass element. The passive radiator in accordance with the invention further comprises first flexible connecting elements 15, which connect the mass element 5 flexibly to the sub-chassis 3, and second flexible connecting elements 17, which connect the sub-chassis 3 flexibly to the chassis 1. In the present embodiment the first connecting elements 15 connect both the front part 5*a* and the back part 5*b* of the mass element to the sub-chassis 3 and the second connecting elements 17 connect the sub-chassis 3 to the chassis 1 both at the location of the front part 5*a* and at the location of the back part 5*b*. If less stringent requirements are imposed on the resistance to tilting it will adequate to use one of the first connecting elements 15 and/or one of the second connecting elements 1.

In the present embodiment the connecting elements take the form of ring-shaped rims of omega-shaped cross-section, the first connecting elements 15 as well as the second connecting elements 17 being disposed in mirror-inverted positions relative to one another. In the present example the rims are made of polyurethane. However, they can alteratively be made of another suitable material, such as rubber. Under the influence of pressure variations the mass element can perform axial movements x along its central axis 5*c*, the mass element 5 having an amplitude A. The extreme positions A1 and A2 of the mass element S are shown diagrammatically in FIG. 1. As is apparent from FIG. 1, the amplitude A is the sum of the maximum excursion of the mass element S relative to the sub-chassis 3 in an axial direction and the maximum excursion of the sub-chassis 3 relative to the chassis 1 in the same axial direction.

In operation the sub-chassis and the chassis as well as the sub-chassis and the mass element form a telescopic suspension device.

Figure 2:
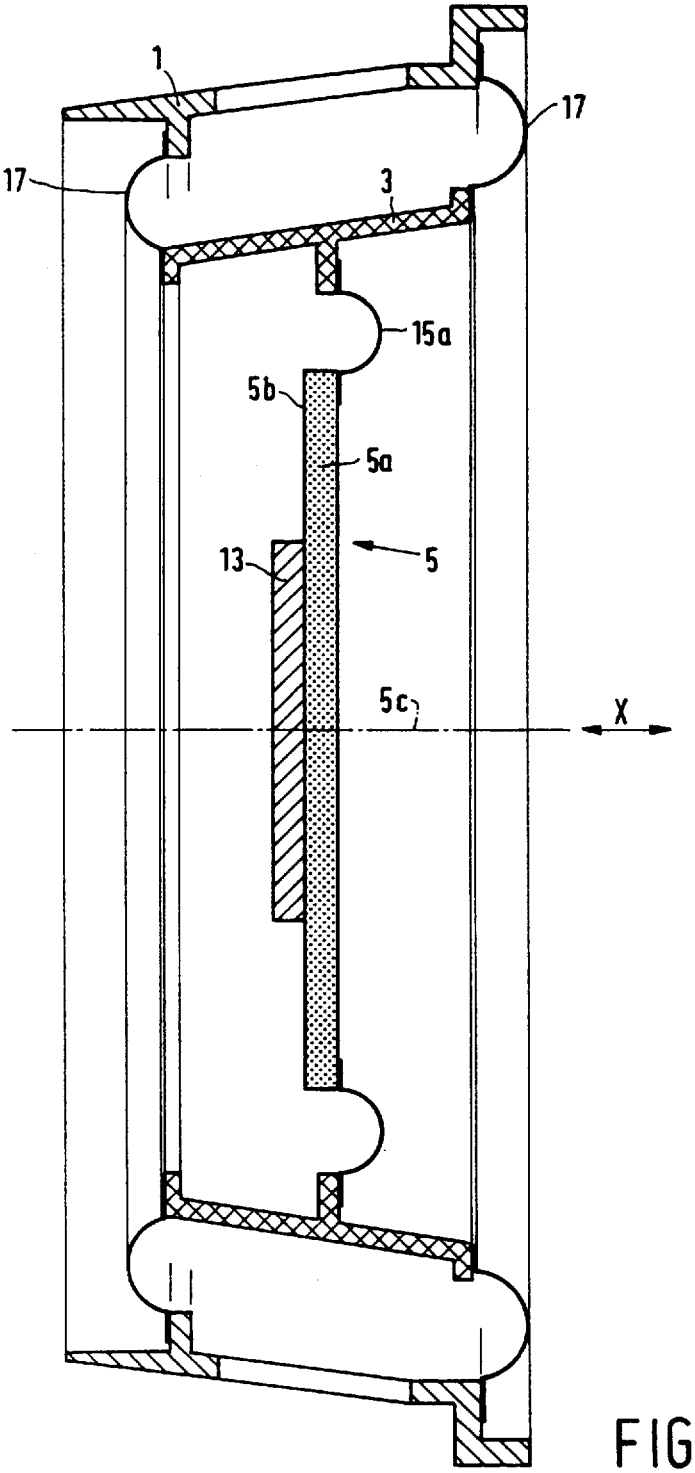
FIG. 2 is a longitudinal sectional view showing a second embodiment of the passive radiator in accordance with the invention.

The passive radiator shown in FIG. 2 bears much resemblance to the embodiment already described. For this reason corresponding parts in FIGS. 1 and 2 bear the same reference numerals.

The embodiment of the passive radiator in accordance with the invention shown in FIG. 2 comprises a chassis 1, a mass element 5 disposed within the chassis 1 and having a first part, i.e. a front part 5*a*, and a second part, i.e. a back part 5*b*, and a sub-chassis 3, which extends between the chassis 1 and the mass element 5. The mass element 5, which is flat in the present example, is connected to the sub-chassis 3 by means of a first flexible connecting member 15*a*, which sub-chassis in its turn is connected to the chassis 1 by means of a second flexible connecting member comprising two flexible connecting elements 17. Both connecting members are flexible and compliant in directions parallel to the central axis 5*c* of the mass element, as a result of which axial movements of the mass element 5 are determined by axial movements of the mass element 5 relative to the sub-chassis 3 and of the sub-chassis 3 relative to the chassis 1. The connecting member 15*a* and the connecting elements 17 in the present example are formed by ring-shaped bodies of omega-shaped cross-section, which present a comparatively high resistance to lateral deformations, i.e. deformations in radial directions with respect to the central axis. One of the parts of the mass element 5, in the present example the back part 5*b*, carries a tuning mass.

Figure 3:
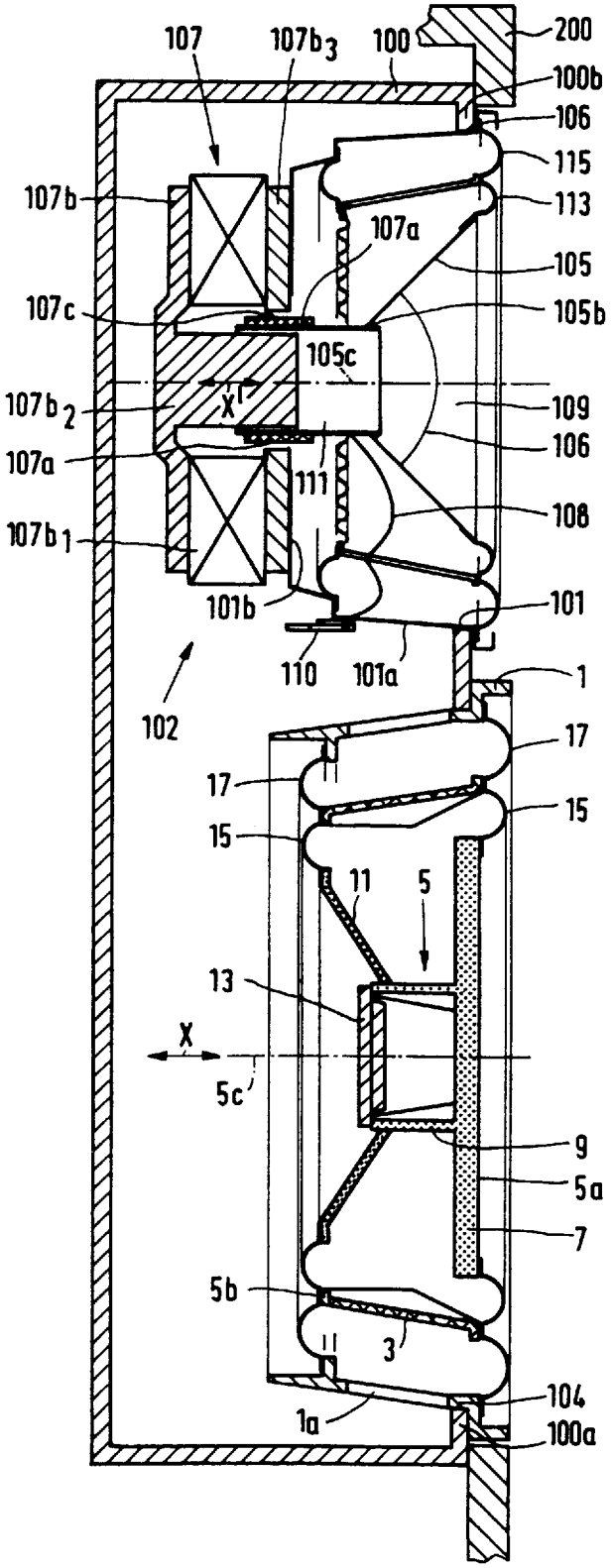
FIG. 3 is a longitudinal sectional view showing an embodiment of the system in accordance with the invention.

The system in accordance with the invention shown in FIG. 3, which is a bass-reflex system, in the present example used in an electronic display device 200 for providing visual information, comprises a housing or enclosure 100, which accommodates a passive radiator in accordance with the invention, in the present example the embodiment shown in FIG. 1, and an electrodynamic loudspeaker 102. The housing 100 has a first opening 104 through which the chassis 1 of the passive radiator extends and a second opening 106 through a chassis 101 of the loudspeaker 102 extends. The chassis 1 and the chassis 101 are secured to respective edge portions 100*a* and 100*b* of the housing 100 around the openings 104 and 106, respectively.

For a further description of the passive radiator reference is made to those parts of the present document which relate to FIG. 1 and, in this respect it is to be noted that the tuning mass 13 has been adapted to the desired Helmholtz resonance of the system.

The loudspeaker used in the system shown here, which loudspeaker is described in more detail in the U.S. Patent Application bearing the Application Ser. No. 08/859,590 (presently indicated as having allowable subject matter; herewith incorporated by reference), comprises a sub-chassis 103, a diaphragm 105 and an electromagnetic actuator 107. The sub-chassis 3, which has a conical shape in the present example, extends between the chassis 101 and the conical diaphragm 105. In this example a dust cap 6 is situated in the diaphragm 105. The sub-chassis 103 has a circumferential surface opposite which sound apertures 101*a* in the chassis 101 are situated. The diaphragm 105 has a front part 105*a* with an aperture 109 and a back part 105*b* with a cylindrical central element 111. The element 111 carries a first actuator part 107*a* of the actuator 107, which part is formed by a coil 107*a*1 in the present example. The coil 107*a*1 is electrically connected to contact terminals 110 via electrical conductors 108, which terminals have been secured to the chassis 101. The actuator 107 further comprises a second actuator part 107*b*, which in the present example comprises a ring magnet 107*b*1, a yoke part 107*b*2 and a yoke part 107*b*3 secured to a chassis part 101*b* of the chassis 101. Between the yoke part 107*b*2 and the yoke part 107*b*3 an air gap 107*c* is formed, in which the coil 107*a*1 extends. When the actuator is energized the coil 107*a*1 and hence the diaphragm 105 perform an axial movement along a diaphragm axis 105*c* in one or in the other axial direction indicated by the double arrow x'.

In the loudspeaker 102 the diaphragm 105 is suspended in the sub-chassis 103 and the sub-chassis 103 is suspended in the chassis 101. For this purpose, the loudspeaker 102 has been provided with a first flexible connecting element 113, which connects the front part 105*a* of the diaphragm 105 to the sub-chassis 103, and a second flexible connecting element 115, which connects the sub-chassis 103 to the chassis 101 at the location of the front part 105*a*. In the present example the connecting elements 113 and 115 are each formed by a ring-shaped element of omega-shaped cross-section. The connecting elements 113 and 115, made of polyurethane in the present example, can be secured to the diaphragm 105 and the sub-chassis 103 and to the sub-chassis 103 and the chassis 101, respectively, by adhesive joints. Preferably, the first connecting element 113 and the second connecting element 115, which are coaxial with one another, are constructed as a one flexible element.

The loudspeaker 102 further comprises a flexible centering element 117, in the present example in the form of a centering disc having a concentric corrugation pattern and made of a suitable material, such as a textile fabric, which element connects the sub-chassis 103 to the back part 105*b*, particularly the central element 111 thereof. The centering element 117 and the connecting elements 113 and 115 form supporting means which are comparatively flexible and compliant in the axial directions indicated by the arrow x' but which are comparatively stiff in the other directions, as a result of which the diaphragm 105 with the coil 107*a*1 as well as the sub-chassis 103 can perform well-defined axial movements relative to the chassis 101. It is obvious that another loudspeaker can be used instead of the loudspeaker shown.

It is to be noted that the invention is not limited to the embodiments disclosed herein. For example, instead of omega-shaped connecting elements and/or members sinusoidal or other suitably shaped connecting elements or members can be used. The shape of the parts of the passive radiator may be determined by the method of manufacturing or the method of assembling.

What is claimed is:

1. A passive radiator comprising a chassis, a mass element having a front part and a back part and disposed within the chassis, and a suspension means for movably suspending the mass element from the chassis, wherein said passive radiator further comprises a sub-chassis, which extends between the chassis and the mass element, the suspension means connecting the sub-chassis telescopically to the mass element and telescopically to the chassis.

2. A passive radiator as claimed in claim 1, wherein the suspension means comprises a first flexible connecting member, which connects the mass element to the sub-chassis, and a second flexible connecting member, which connects the sub-chassis to the chassis.

3. A passive radiator as claimed in claim 2, wherein the first connecting member comprises two flexible first connecting elements, which connect the mass element to the sub-chassis at the front part and at the back part.

4. A passive radiator as claimed in claim 2, wherein the second connecting member comprises two flexible connecting elements, which connect the sub-chassis to the chassis at least substantially at the location of the front part and at least substantially at the location of the back part of the mass element.

5. A passive radiator as claimed in claim 3, wherein the first connecting elements are ring-shaped and are in coaxially positioned with respect to one another.

6. A passive radiator as claimed in claim 4, wherein the second connecting elements are ring-shaped and are in coaxial positions relative to one another.

7. A passive radiator as claimed in claims 3, wherein the first connecting elements and the second connecting elements allow mainly movements of the mass element along an axis of translation of the mass element and counteract other movements.

8. A passive radiator as claimed in claim 3, wherein said connecting elements each have a corrugated or undulate structure.

9. A passive radiator comprising a chassis, a mass element having a front part and a back part and disposed within the chassis, and a suspension means for flexibly suspending the mass element from the chassis, wherein said passive radiator further comprises a sub-chassis, which extends between the chassis and the mass element, the suspension means comprising a first flexible connecting member, which connects the mass element to the sub-chassis, and a second flexible connecting member, which connects the sub-chassis to the chassis.

10. A loudspeaker system comprising an electrodynamic loudspeaker, the passive radiator as claimed in claim 1, and an enclosure for accommodating the loudspeaker and the passive radiator.

11. A device for providing audible and/or visual information and accommodating the loudspeaker system as claimed in claim 10.

* * * * *